United States Patent [19]

Hedrick

[11] 4,445,637

[45] May 1, 1984

[54] AIR REGISTER WITH AUTOMATIC ZONE CONTROL

[75] Inventor: Warren R. Hedrick, Holland, Mich.

[73] Assignee: Interpace Corporation, Parsippany, N.J.

[21] Appl. No.: 449,593

[22] Filed: Dec. 14, 1982

[51] Int. Cl.[3] ..... F24F 13/14

[52] U.S. Cl. ..... 236/49; 98/40 VT; 98/103; 236/100

[58] Field of Search ..... 236/49, 100; 98/40 VT, 98/103, 107, 108, 114

[56] References Cited

U.S. PATENT DOCUMENTS

| | | | |
|---|---|---|---|
| 1,884,794 | 10/1932 | McKee | 236/100 |
| 2,241,108 | 5/1941 | Akers | 236/49 |
| 2,523,497 | 9/1950 | Copping | 236/49 |
| 2,523,498 | 9/1950 | Copping | 236/49 |
| 2,523,499 | 9/1950 | Copping | 236/49 |
| 2,537,315 | 1/1951 | Newton | 236/49 |
| 2,628,032 | 2/1953 | Copping | 236/49 |
| 2,701,101 | 2/1955 | Peple, Jr. | 236/49 |
| 2,740,587 | 4/1956 | Kraft | 236/49 |
| 2,749,044 | 6/1956 | Chace | 236/49 |
| 2,814,977 | 12/1957 | Noll | 236/49 X |
| 3,165,999 | 1/1965 | Noll | 236/49 X |
| 3,645,108 | 2/1972 | Houk | 236/49 X |
| 3,743,180 | 7/1973 | Perkins et al. | 236/49 X |
| 4,055,954 | 11/1977 | Marks et al. | 60/527 |
| 4,151,952 | 5/1979 | Edwards | 236/49 |

*Primary Examiner*—William E. Tapolcai

*Attorney, Agent, or Firm*—Varnum, Riddering, Schmidt & Howlett

[57] ABSTRACT

An air register for distributing air to a room has a thermally responsive actuator element in direct contact with a pivotably mounted closure slat for controlling the flow of air through the register. The air is distributed upwardly along the wall of a room and a venturi, mounted in the air flow path, draws air in through an opening in the front of the register and over the actuator so that the actuator senses room temperature of the treated air passing through the register. The slats which control the flow of air through the register are biased in an open position and the actuator tends to close the slats through a direct linear force on the slats.

8 Claims, 4 Drawing Figures

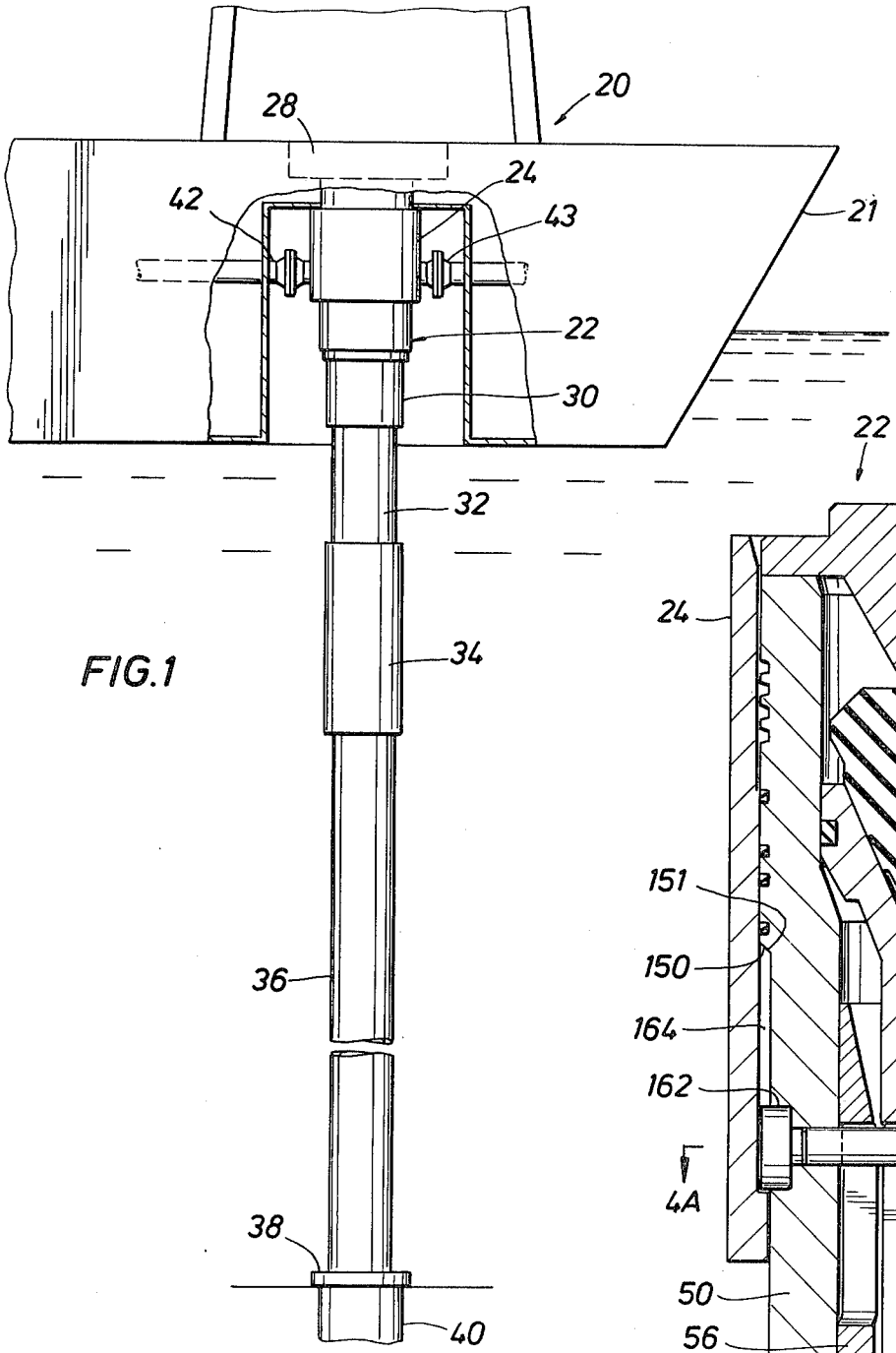
FIG.1
FIG. 4
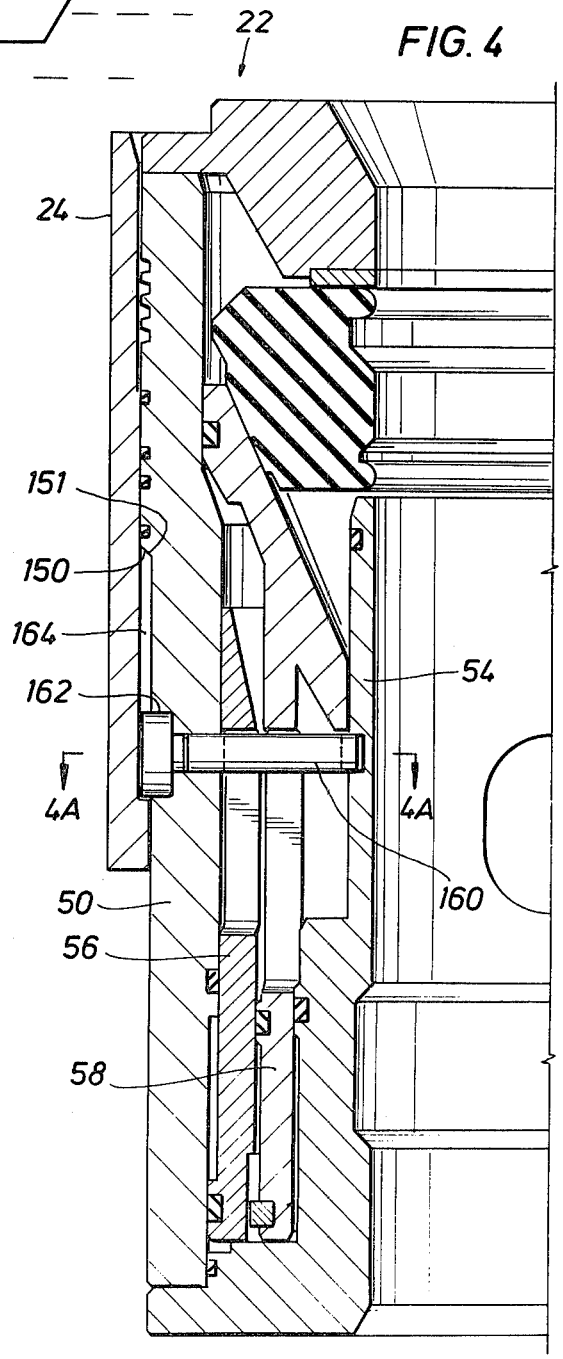
FIG. 4A
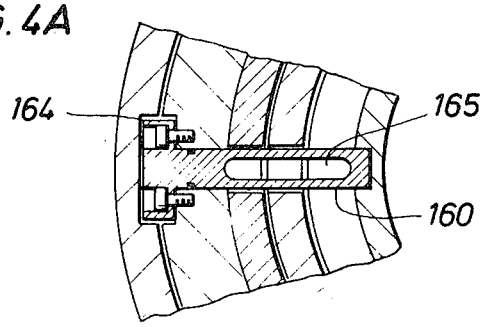

FIG. 5
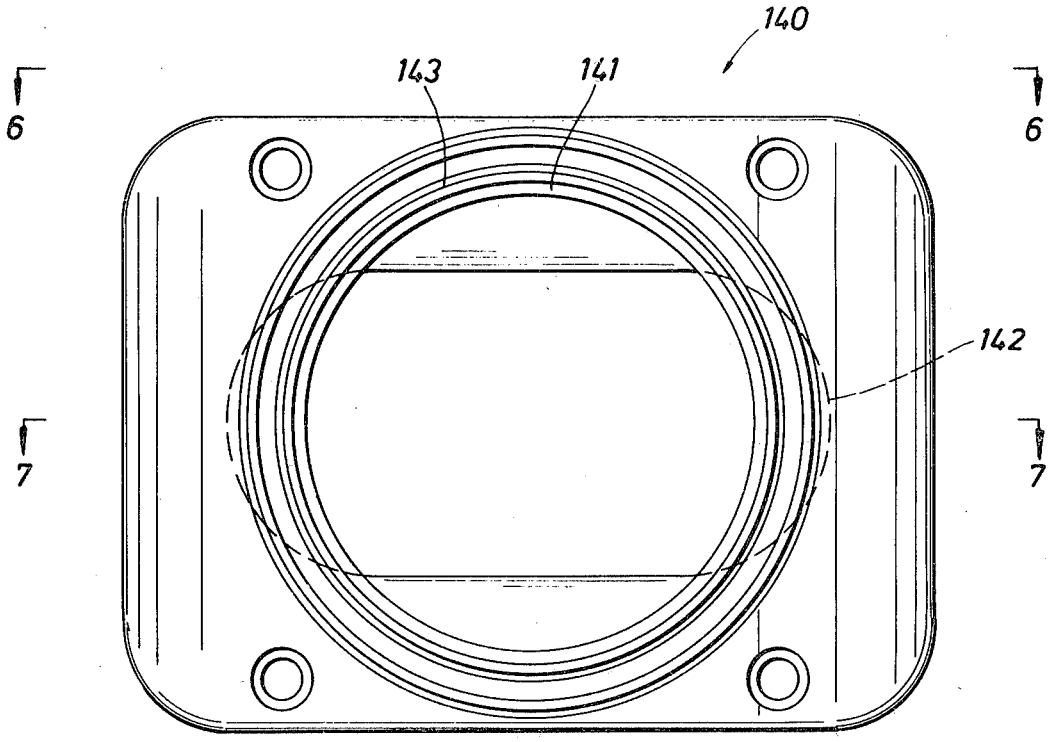
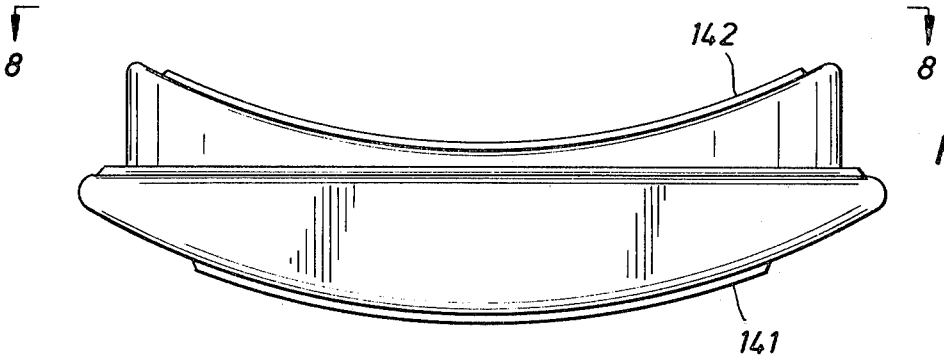
FIG. 6
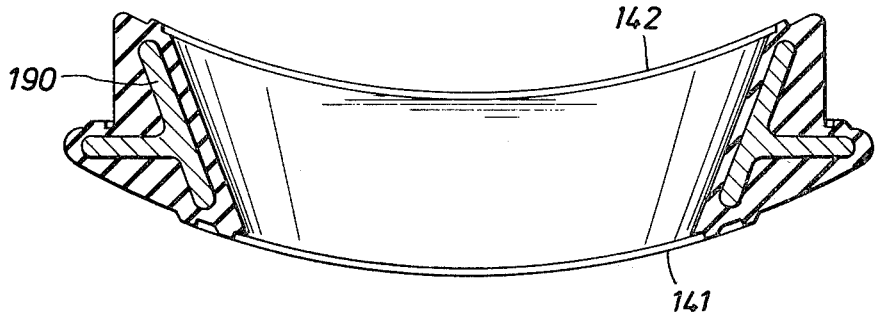
FIG. 7

FIG. 8
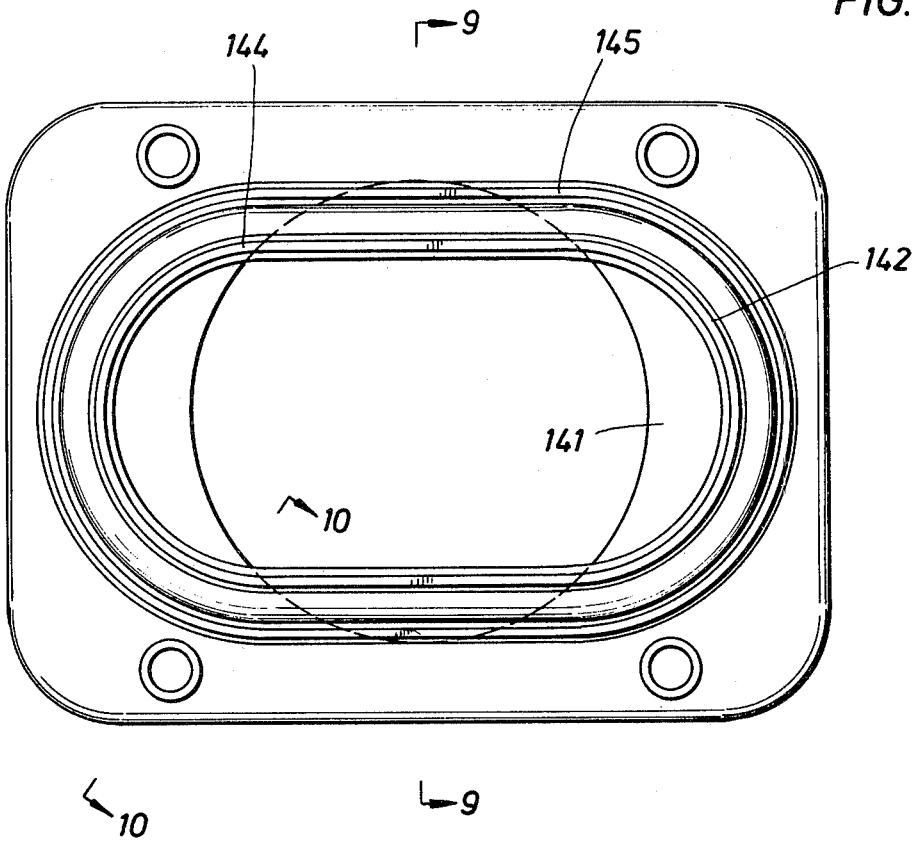
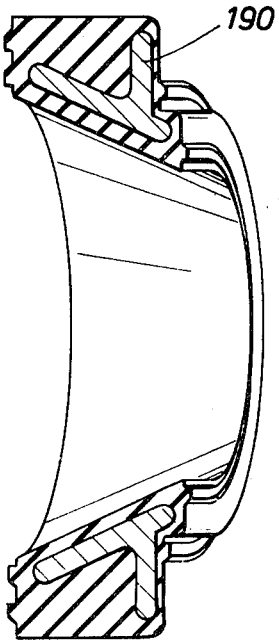
FIG. 9
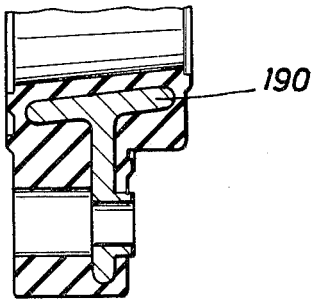
FIG. 10

AIR REGISTER WITH AUTOMATIC ZONE CONTROL

BACKGROUND OF THE INVENTION

1. Field of the Invention

This invention relates to zone-controlled registers. In one of its aspects, the invention relates to an air register in which a thermally responsive motor linearly drives damper blades in an air register to control the flow of treated air in accordance with the temperature of the air in the room.

2. State of the Prior Art

Zone-controlled registers are devices which control the flow of heated or cooled air into a room independent of the thermostatic setting for a building to adjust the flow of air for the effects of sunlight, wind, people and other exterior effects on the building. These devices have been known for years but have apparently not been widely used. More recently, with the dramatic increase in fuel prices, the use of these devices has become more attractive to save energy.

Examples of thermostatically controlled ventilators are disclosed in the following U.S. Pat. Nos.:

Copping U.S. Pat. No. 2,523,497, issued Sept. 26, 1950;

Copping U.S. Pat. No. 2,523,498, issued Sept. 26, 1950;

Copping U.S. Pat. No. 2,523,499, issued Sept. 26, 1950;

Copping U.S. Pat. No. 2,628,032, issued Feb. 10, 1953;

Chace U.S. Pat. No. 2,749,044, issued Jun. 5, 1956.

In each of the devices in the above-enumerated patents, a shutter element is pivotably mounted in an air register which directs air principally in a horizontal direction into a room from a horizontal duct. A shutter is pivotably mounted on a pair of twisted wires at one end to apply a torque to the shutter tending to close the shutter. A thermally responsive actuator is mounted on the side of the register and is connected to the pivotable mounting of the shutter so as to reduce the torque created by the twisted wires and thereby oppose the torsional force of the wires. The actuator is provided in an opening and air is aspirated into the register over the actuator so that the actuator senses the room temperature rather than the temperature of the treated air passing through the register. Heating of the actuator reduces the torsional force applied to the shutter and thereby closes the shutter. Closing of the shutter must take place against the pressure of the air passing through the register and against the frictional forces present in the system. With the frictional forces and air-flow resistance, the balancing of the forces between the actuator and the wire at the axis of rotation may result in a significant lack of sensitivity of this device.

Other types of actuators for registers have used vapor-filled bellows mechanically connected to a linearly movable shutter and to a pivotably mounted shutter. See, for example, Newton U.S. Pat. No. 2,537,315, issued Jan. 9, 1951, and Peple, Jr. U.S. Pat. No. 2,701,101, issued Feb. 1, 1955. The mechanical advantage of the bellows mechanism is not significant and it may therefore be difficult to overcome the frictional and air-resistant forces with this type of mechanism to provide sufficient sensitivity for operation of the damper mechanism.

In all of the zone-controlled registers discussed above, the operating mechanisms appear to be fairly complex and would also appear to lack sufficient positive available force so that the register is relatively sensitive to relatively small changes in temperature.

Wax motors are recognized as forceful actuators which have been used to control fluid valves (McKee U.S. Pat. No. 1,884,794, issued Oct. 25, 1932), and to control ventilation system actuators (Marks et al U.S. Pat. No. 4,055,954, issued Nov. 1, 1977). These actuators are recognized to exhibit a significant linear force.

A common form of ventilation system uses a simple housing placed on a floor adjacent to a wall and distributes heated air from a duct extending to the floor upwardly into the room through louvers in the front face of the register. A vane is pivotably mounted in the front panel and has an exterior manual handle to control the flow of air through the louvers. It is desired to have a temperature control in this type of simple housing using relatively simple, yet reliable actuator elements. Such a system could be used to retrofit existing systems as well as for new construction.

SUMMARY OF THE INVENTION

According to the invention, a zone-controlled register is simple in principle and construction, yet works positively against the flow of air and frictional forces with a strong motor to sensitively control the flow of treated air through the register. The simple system provides for new as well as retrofit installations at a relatively low cost.

The air register in which the invention is used comprises a back housing having a back wall and a bottom wall with openings therein to pass heated air therethrough. A front housing has a front wall and a plurality of louvers to direct heated air passing through the back housing opening in the bottom wall upwardly along the wall of a room. Means are provided for mounting the front housing assembly to the back housing. The front housing includes a closure means mounted for pivotable movement between a first position wherein the flow of heated air through the bottom wall opening is at least substantially restricted and a second position wherein the flow of heated air through the bottom wall opening is substantially unimpeded.

According to the invention, an opening is provided in the front wall of the front housing spaced beneath the louvers. A venturi means is provided in the front housing in communication with the front wall opening and aligned with the bottom opening to draw ambient air through the front wall opening. A thermal actuator means is mounted in the front wall opening and has an actuator element which is extendible and retractable responsive to temperature variations of the actuator. The actuator element is in direct contact with the closure means to apply a linear force to the closure means as the thermal actuator rises in temperature.

The closure means preferably comprises a pair of slats, each of which is pivotably mounted in the front housing. The slats are so positioned such that there is a gap between the slats when the slats are in the first position so that heated air always flows through the venturi means, even when the slats are in the first or closed position. The slats are preferably biased into the second position and the actuator element moves in a linear direction perpendicular to the axis of rotation of the slats. Preferably, the actuator is filled with a wax which changes from a liquid to a solid with temperature changes. An override means is provided on the front housing to manually close the closure means. The thermal actuator is preferably threaded into the front housing so that minor adjustments can be made for different temperatures. The venturi means is positioned downstream of the slats.

BRIEF DESCRIPTION OF THE DRAWINGS

The invention will now be described with reference to the accompanying drawings in which.

DESCRIPTION OF THE PREFERRED EMBODIMENT

Figure 2:
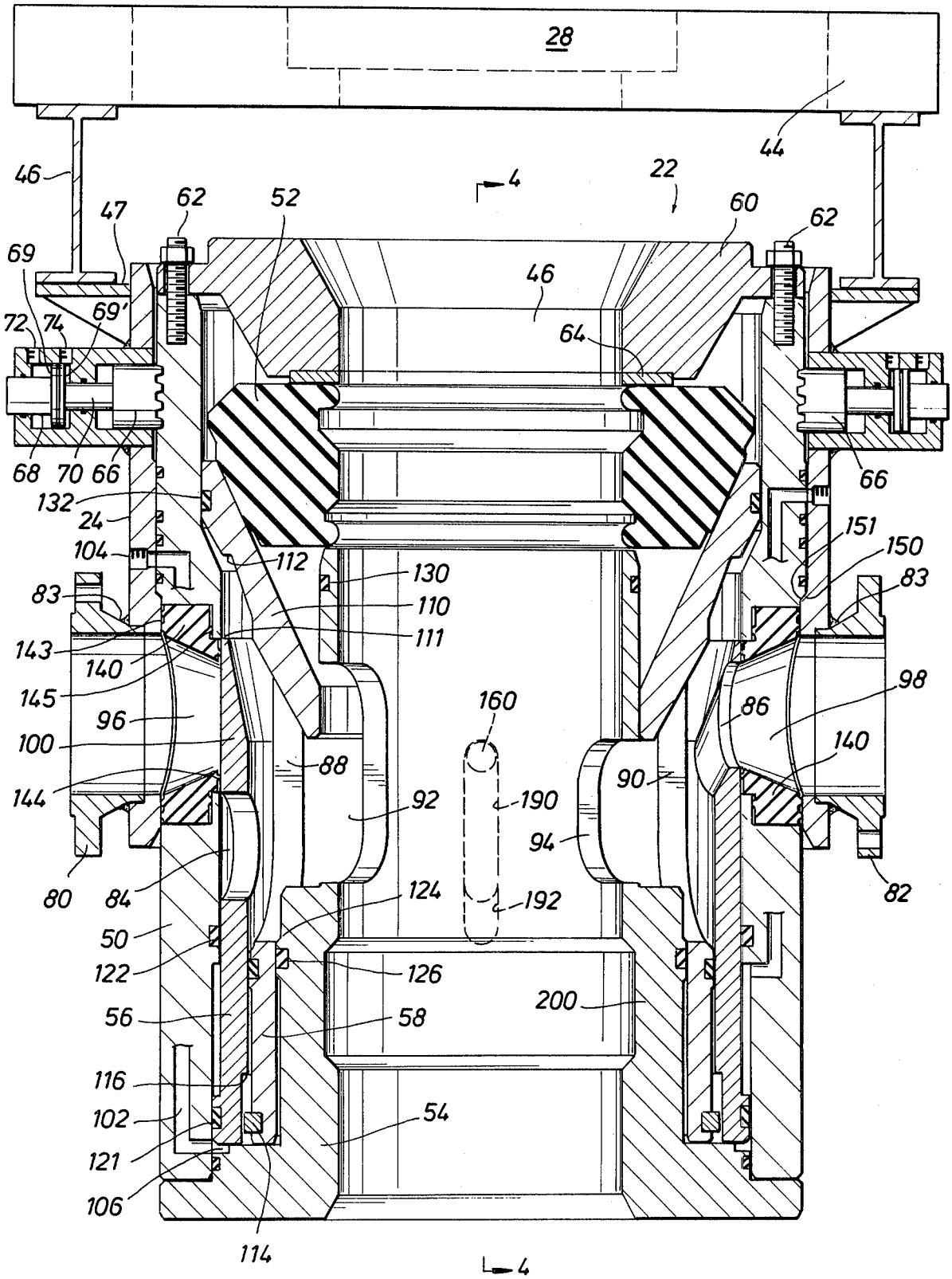
FIG. 2 is a plan view of the zone controlled register shown in FIG. 1.

Referring now to the drawings, there is shown a zone control register which is positioned in conventional fashion against a wall 10 and on a floor 12 through which a duct 14 extends. The register has a back housing 16 comprising a back wall 18, a top wall 20, a pair of front flanges 22 forming an open face thereof, a bottom wall 26 having openings 28 and side walls 29.

According to the invention, a front housing assembly 70 incorporating a venturi and a temperature controlled actuator for the slats 30 and 34 is secured to the back housing 16 through sheet metal screws 72. Air-directing louvers 74 are provided at the top and sides of the front housing assembly 70 for directing the air along the walls into the room.

Figure 1:
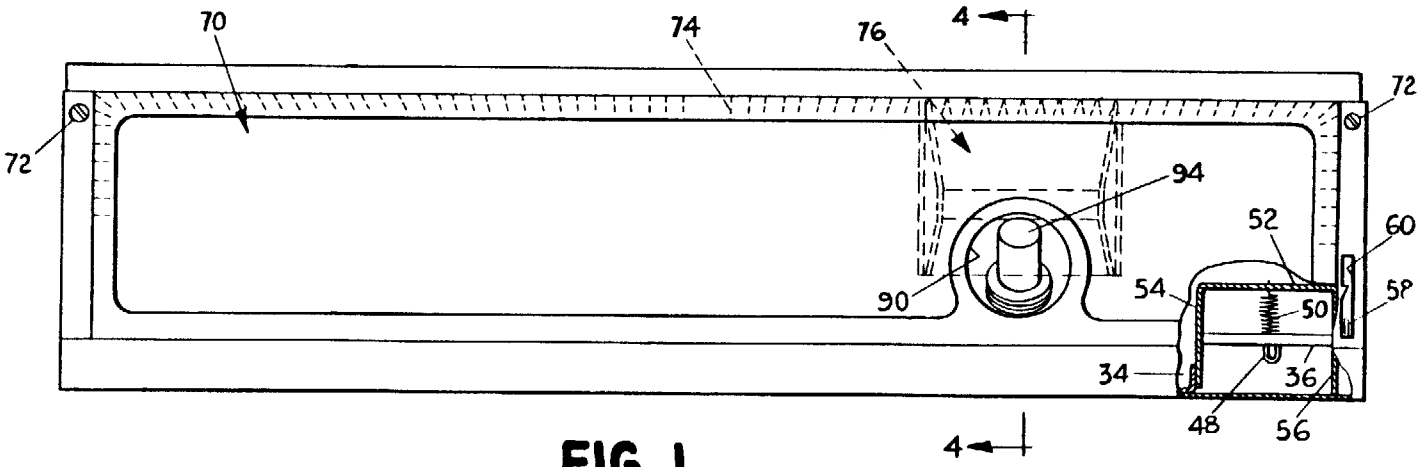
FIG. 1 is a front, elevational view of a zone control register according to the invention, with a portion of the front wall thereof being broken away.
Figure 2:
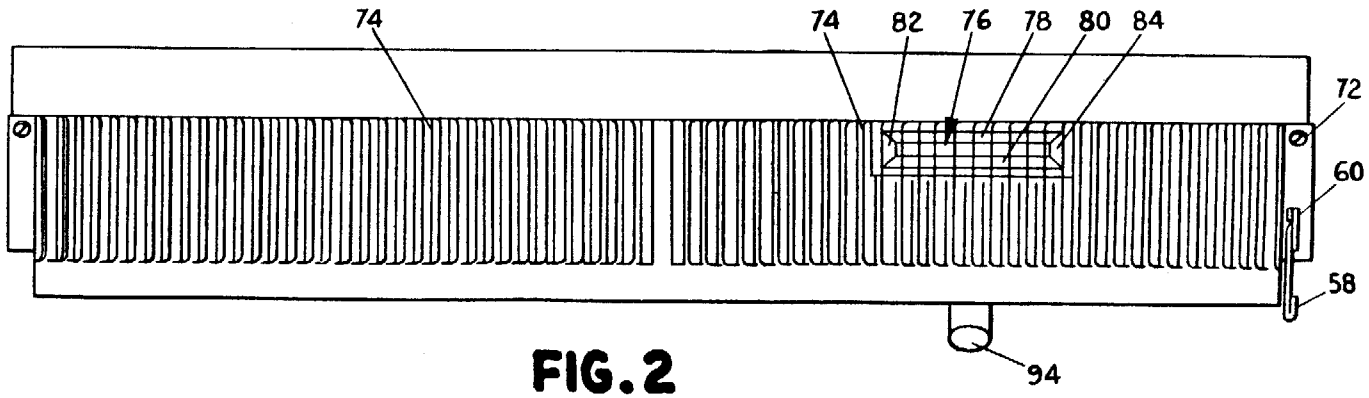
Figure 3:
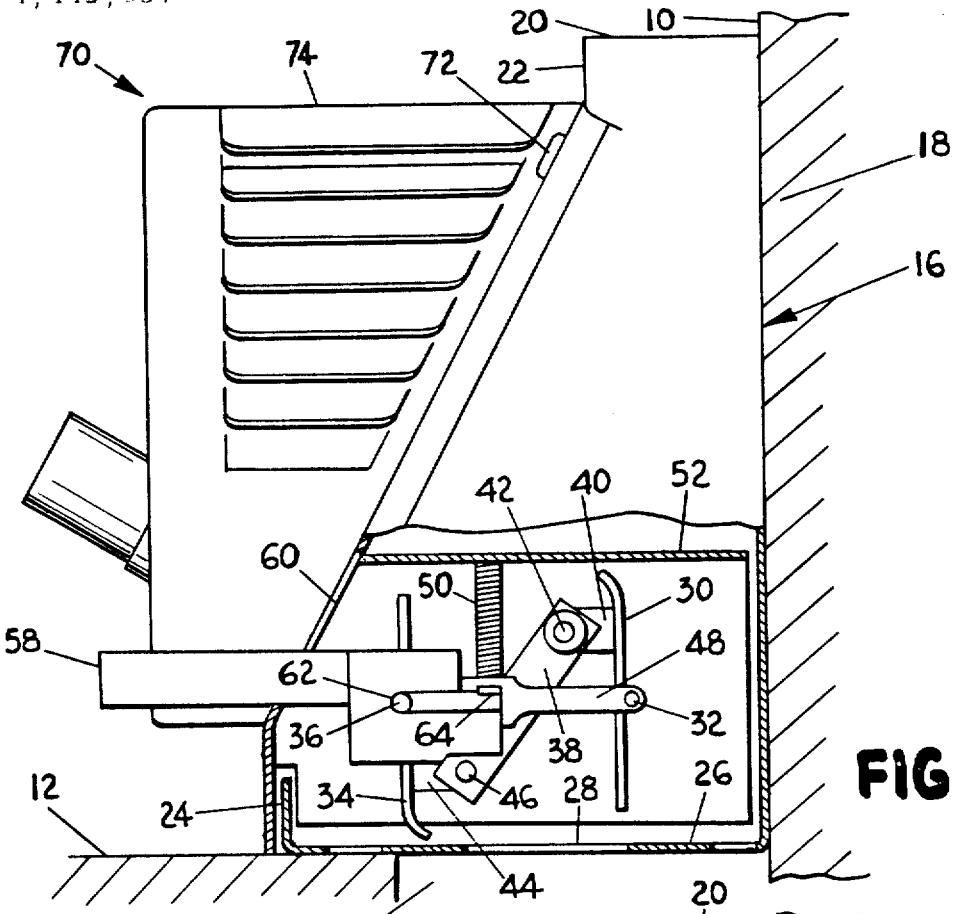

A horizontal partition 52 extends between vertical partitions 54 and 56 on the right side of the housing 70 as viewed from FIG. 1 to form a small chamber. The shafts 32 and 36 are journalled in partitions 54 and 56 in the right side of the front housing 70 (as viewed in FIG. 1) and in a similar vertical partition (not shown) in the left side of the front housing 70.

Figure 3:
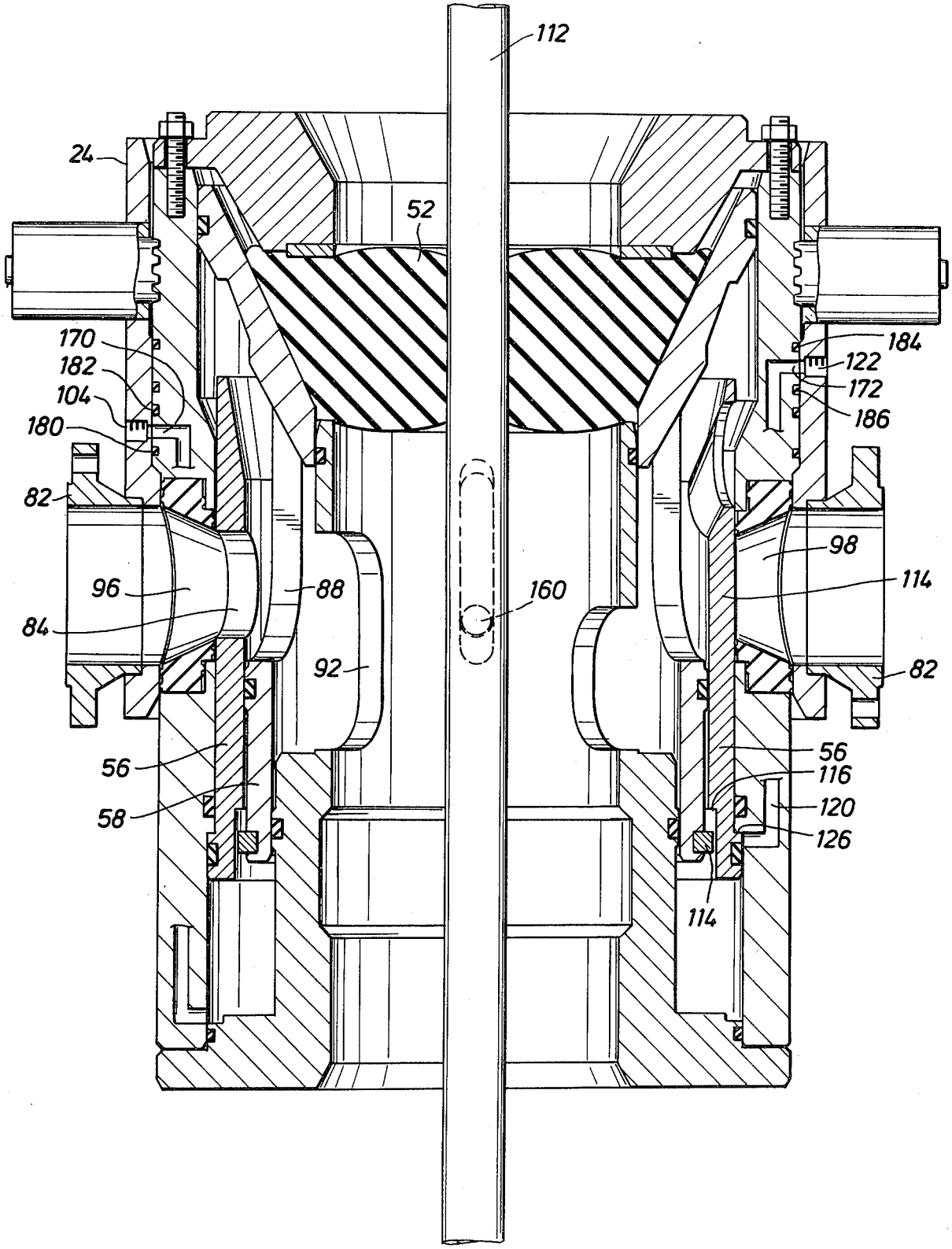
FIG. 3 is a side elevational view of the zone control register shown in FIG. 1 as seen from the right side thereof.
Figure 11B:
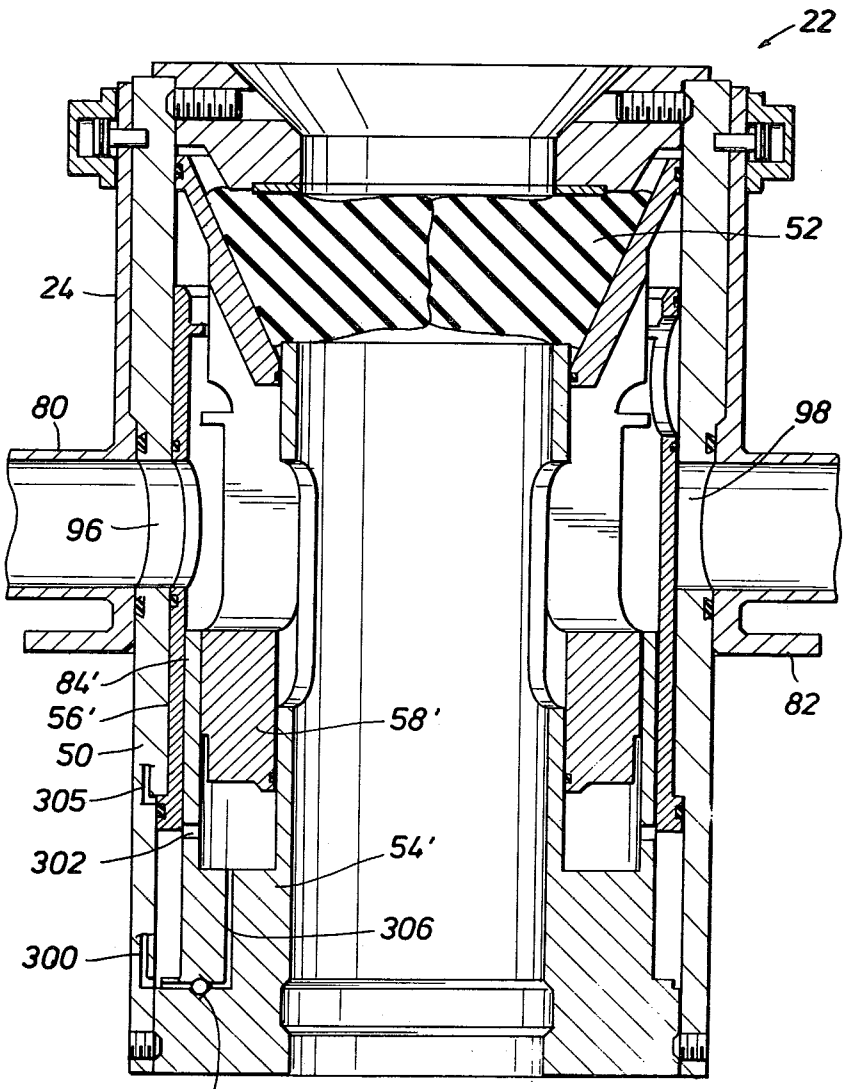
Figure 11A:
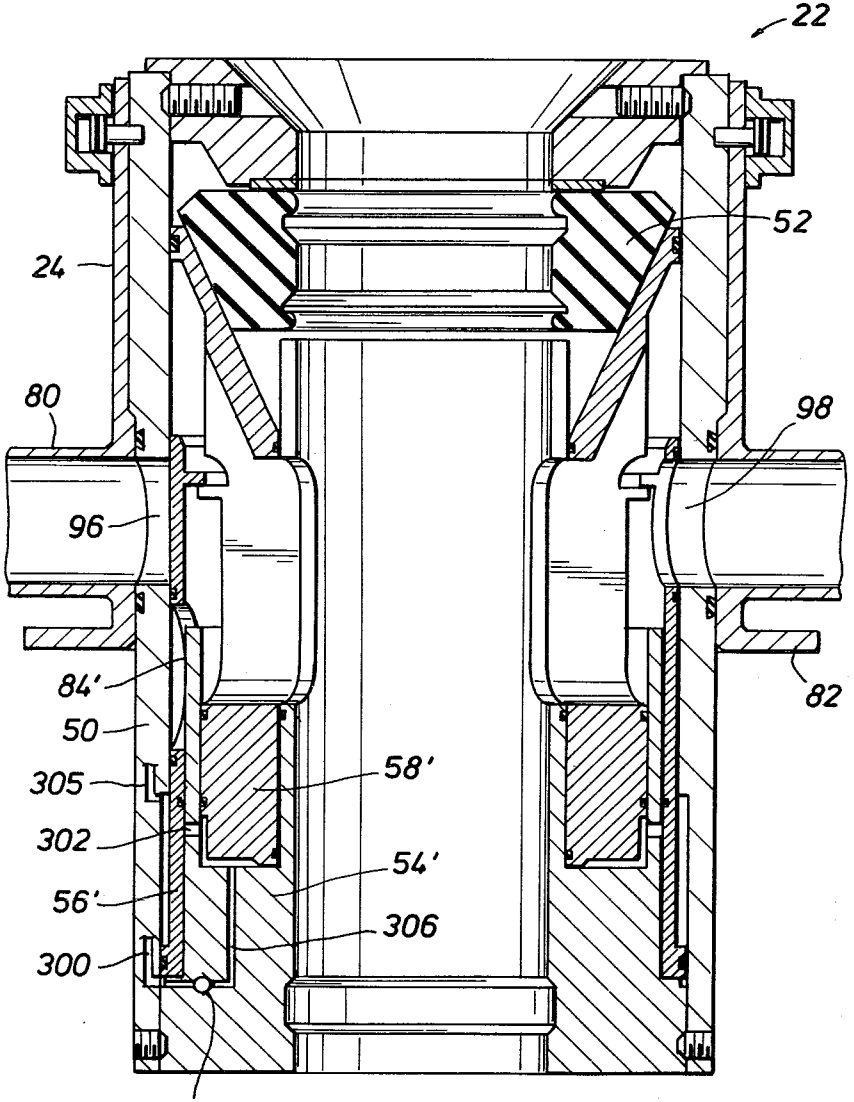
Figure 12B:
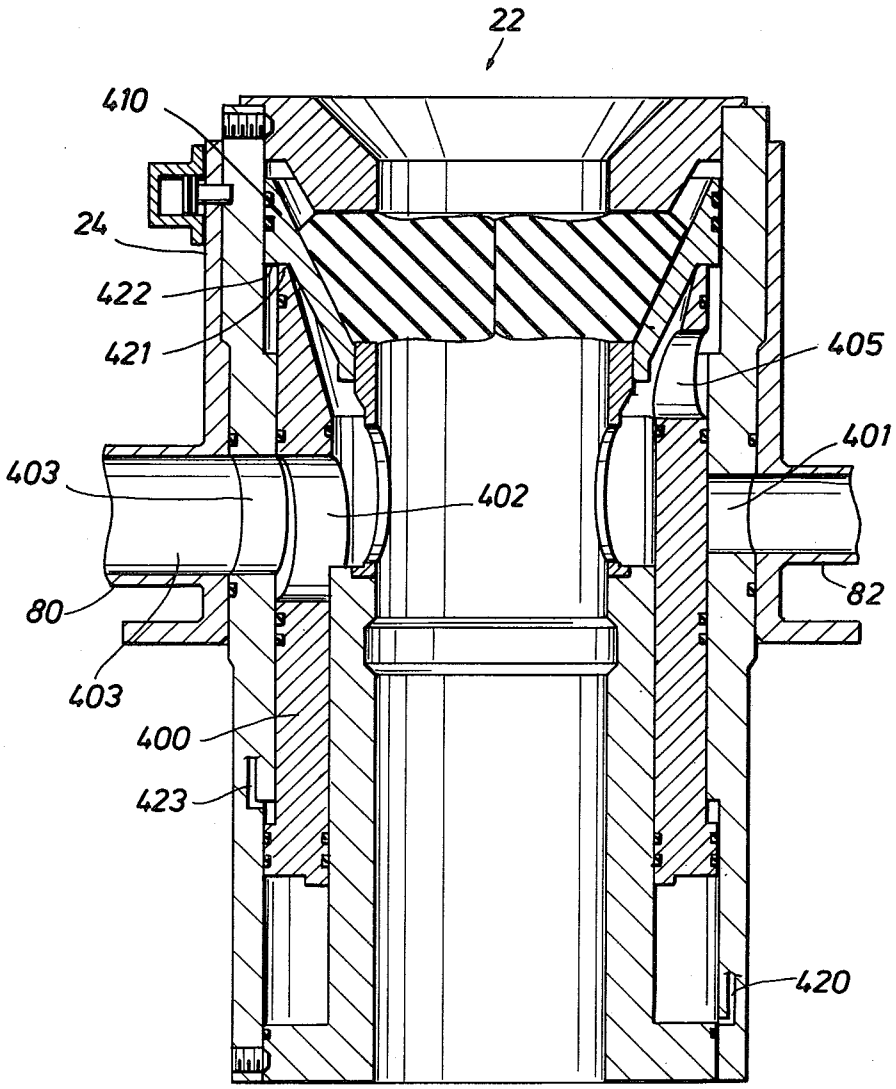
Figure 12A:
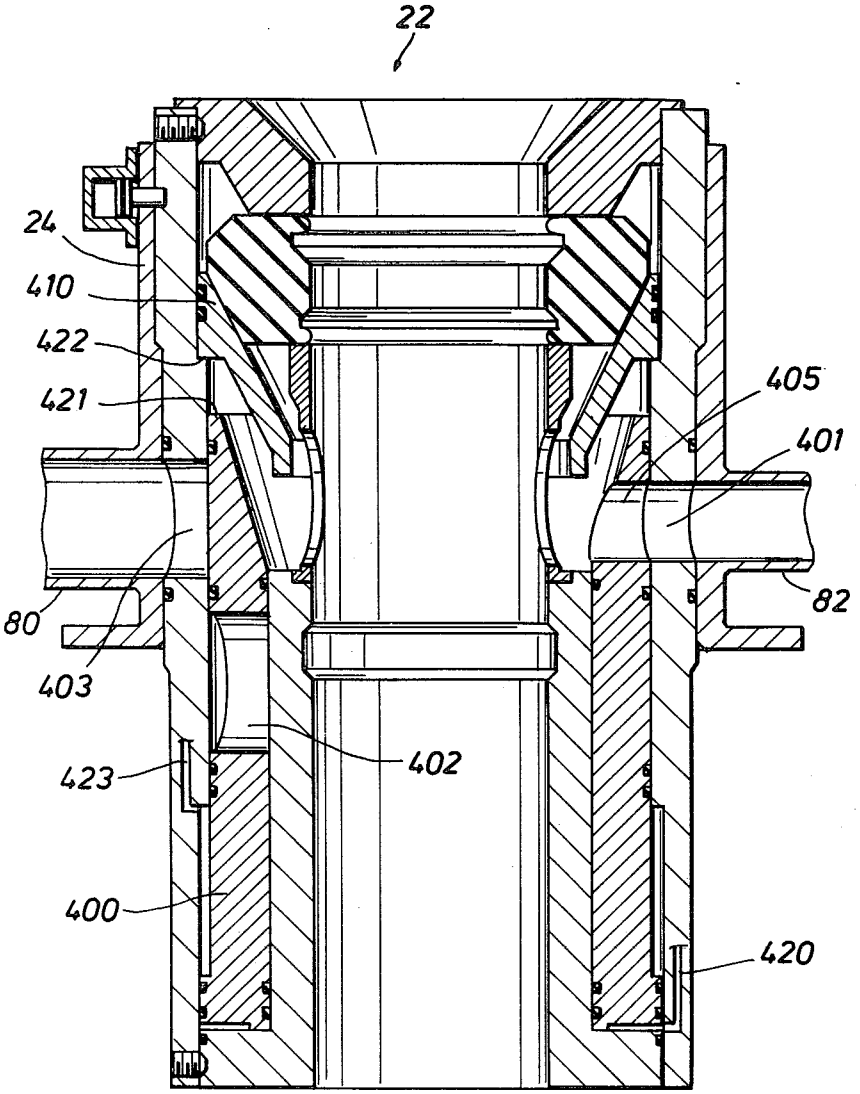
Figure 13C:
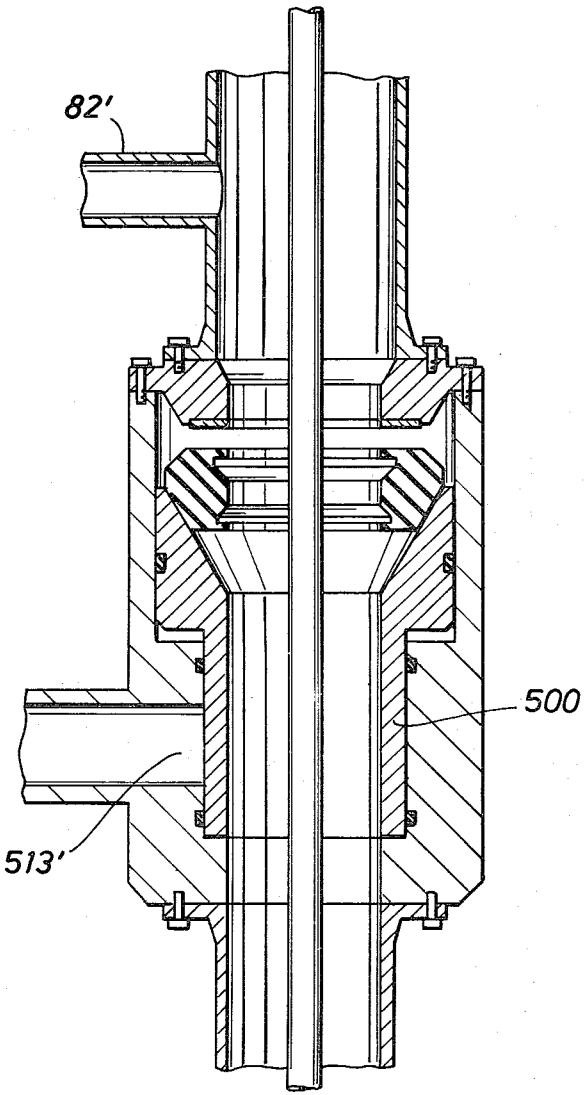
Figure 13B:
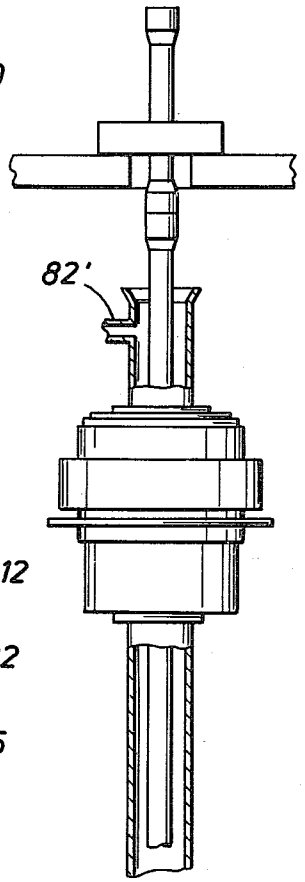
Figure 13A:
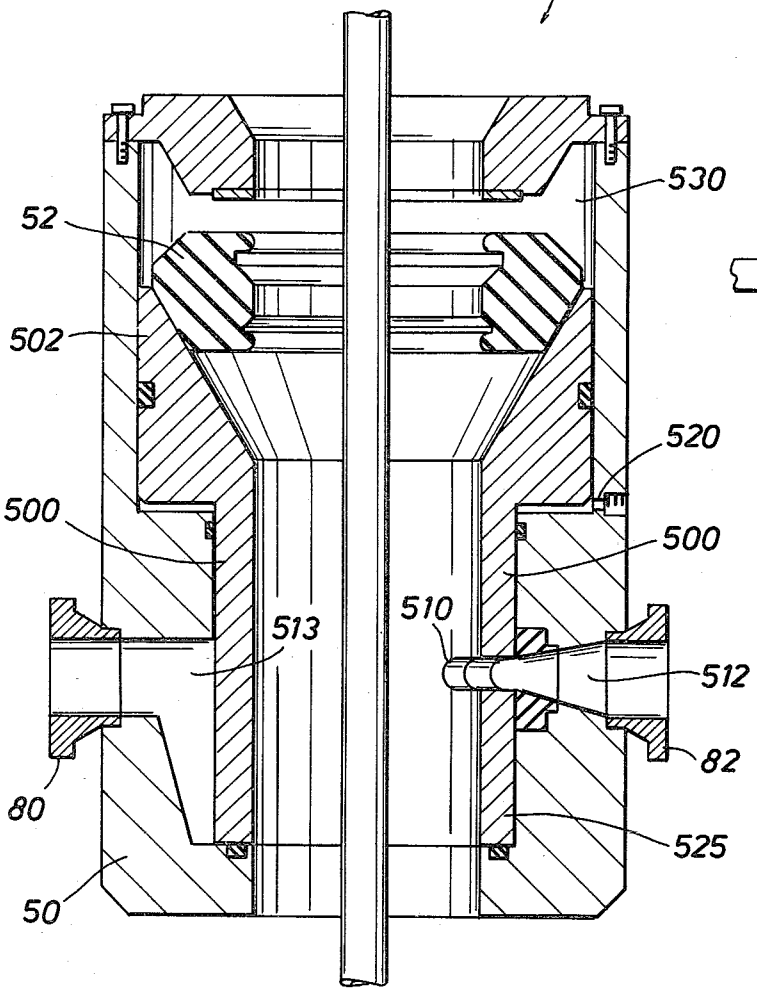

Slats 30 and 34 are pivotably mounted within the front housing assembly 70 for rotation about shafts 32 and 36, the slats 30 and 34 being nonrotatably mounted to the shafts 32 and 36 so as to rotate therewith. A link 38 connects the slats through a flange 40 on the slat 30, a pin 42, a flange 44 on the slat 34 and a pin 46. The shaft 36 is bent forwardly to form a lever 48 and is connected to a tension spring 50. The upper portion of the tension spring is connected to the horizontal partition 52. In this manner, the slats 30 and 34 are biased in the open position, illustrated in FIGS. 3 and 4.

An override handle 58 extends through a slot 60 in the front of the register and is mounted on an end portion of the shaft 32. An end tab 64 of the handle 58 engages a lever formed by bending the right end of shaft 32 rearwardly so that the handle can rotate the shaft 32 and the slats 30 and 34. Thus, the handle 58 can be used to close the slats 30 and 34 by raising the handle. However, the shaft 32 can rotate in a clockwise direction as viewed in FIG. 3 when the handle 58 is in the inactive position illustrated in FIG. 1.

A venturi 76 is built into the housing assembly 70 and is formed by converging metal side plates 78, 80 and by converging metal end plates 82 and 84. Openings 86 are provided in the narrowest portion of the metal plate 78. A tubular conduit 88 which extends to an opening 90 in the face plate 70 provides an open communication between ambient air near the floor of the room and the openings 86 in the venturi throat. A wall portion 92 of the conduit 88 has a threaded opening in which is threaded a thermal actuator 94. The actuator 94 has an exterior threaded central portion which engages the threads of the opening 92 and has a movable, spring return actuator element 98 which abuts the slat 30. The actuator is thus adjustable with respect to the slat 30 by merely rotating the actuator clockwise or counterclockwise.

In operation, as the room air increases due to the supply of heated air to the room, the thermal actuator 94 will increase in temperature and the actuator element 98 will extend, thereby closing the slats 30 and 34. When the room air cools down, the thermal actuator element 98 retracts, thereby allowing the slats to open again under the force of spring 50 and assisted by the flow of air through the register. The flow of air through the venturi 78 draws room air through the opening 86 and around the thermal actuator 94 so that the temperature of the thermal actuator reflects the room temperature near the floor rather than the temperature of the air passing through the register.

Figure 4:
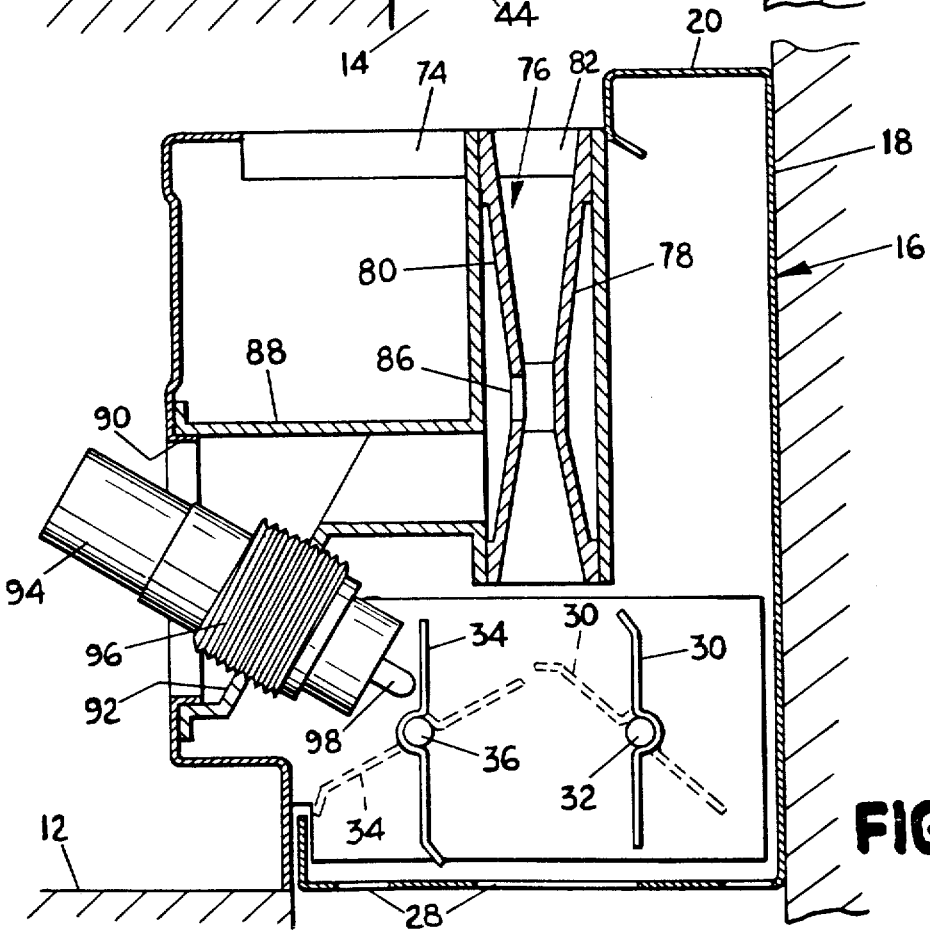
FIG. 4 is a sectional view taken along lines 4—4 of FIG. 1.

As illustrated in phantom lines in FIG. 4, the linkages between slats 30 and 34 are so constructed that complete extension of actuator element 98 will leave a slight opening between slats 30 and 34. Thus, even when the actuator element is fully extended, heated air will flow through the venturi 76. Thus, the actuator 94 will continue to sense room temperature regardless of the position of the actuator element.

The thermal actuator is preferably a wax-filled actuator in which the wax changes state from a solid to a liquid with relatively small changes of temperature to drive the movable element 98 outwardly or inwardly with relatively small changes in temperature. Actuators of this type are called "wax motors" and are commercially available from Standard Thompson, Inc., of Waltham, Massachusetts, and Robert Shaw Controls of Knoxville, Tennessee.

The thermal actuator applies a linear force directly to the slat 34 for positive and direct movement of the slats 30, 34. The linear force produced by the actuator 94 has a significant mechanical advantage on the slat 34 to overcome frictional and air resistance and the tension in spring 50. Thus, there is no dependence on spring tension or weaker torsional forces to damp the flow of air through the register. On the other hand, the tension in spring 50 is assisted by the flow of air across the slats to maintain the slat 34 in contact with the actuator element 98 as the actuator cools.

Thus, the invention provides simple and inexpensive means whereby the temperature of the air in the room can be controlled, notwithstanding abnormal environmental effects such as sunlight, wind and the like. The unit also provides for retrofit of existing vents by simply removing the face plate from existing vents and inserting the face plate 70 which carries the venturi 76 and the thermal actuator element 94.

Reasonable variation and modification are possible within the scope of the foregoing disclosure and drawings without departing from the spirit of the invention.

The embodiments of the invention in which an exclusive property or privilege is claimed are defined as follows:

1. In an air register adapted to be positioned on the floor of a room in abutting relationship to a wall for distributing air to the room, the air register comprising:

a back housing having a back wall and a bottom wall with openings therein to pass heated air therethrough;

a front housing comprising a front wall and a plurality of louvers to direct heated air passing through said back housing opening in said bottom wall upwardly along the wall of the room;

closure means mounted for pivotable movement between a first position wherein the flow of heated air through the bottom wall opening is at least substantially restricted and a second position wherein the flow of heated air through the bottom wall opening is substantially unimpeded; and means for mounting said front housing assembly to said back housing;

the improvement which comprises:

an opening in the front wall of the front housing spaced beneath the louvers;

venturi means in said front housing communicating with said front wall opening and aligned with the back housing opening to draw ambient air through the front wall opening; and thermal actuator means mounted in the front wall opening and having an actuator element which is extendible and retractable responsive to temperature variations of said thermal actuator, said actuator element being in direct contact with said closure means to close down said closure means as said thermal actuator is heated.

2. An air register according to claim 1 wherein the closure means is biased to said second position.

3. An air register according to claim 2 and further comprising override means for said closure means mounted in the front housing to manually close the closure means.

4. An air register according to claim 1 wherein the actuator is filled with a wax composition.

5. An air register according to claim 1 and further comprising means to adjust the position of the thermal actuator with respect to the cover assembly to thereby adjust the relationship between the actuator element and the closure means.

6. An air register according to claim 1 wherein the closure means comprises a pair of slats, each pivotably mounted in the front housing, said slats being so positioned such that there is a gap between said slats when said slats are in the first position so that heated air flows through said venturi means even when said slats are in said first position.

7. An air register according to claim 6 wherein said venturi means are positioned downstream of said slats.

8. An air register according to claim 7 wherein said slats are biased to said second position and further comprising override means for said closure means mounted in said cover assembly to manually move said slats to said first position; means to adjust the position of the thermal actuator with respect to the cover assembly to thereby adjust the relationship between the actuator element and said slats; and said actuator is filled with a wax composition which changes state with temperature changes.

* * * * *

UNITED STATES PATENT AND TRADEMARK OFFICE

CERTIFICATE OF CORRECTION

PATENT NO. : 4,445,637

DATED : May 1, 1984

INVENTOR(S) : Warren R. Hedrick

It is certified that error appears in the above-identified patent and that said Letters Patent is hereby corrected as shown below:

The title page showing the illustrated Figure should be deleted to appear as per attached title page.

The sheets of drawings consisting of Figures 1 thru 13C should be deleted to be replaced with two (2) sheets of drawings as shown on the attached sheets.

Signed and Sealed this

*First* Day of *January 1985*

[SEAL]

*Attest:*

*Attesting Officer*

GERALD J. MOSSINGHOFF

*Commissioner of Patents and Trademarks*

United States Patent [19]

Hedrick

[11] 4,445,637

[45] May 1, 1984

[54] AIR REGISTER WITH AUTOMATIC ZONE CONTROL

[75] Inventor: Warren R. Hedrick, Holland, Mich.

[73] Assignee: Interpace Corporation, Parsippany, N.J.

[21] Appl. No.: 449,593

[22] Filed: Dec. 14, 1982

[51] Int. Cl.[3] ..... F24F 13/14

[52] U.S. Cl. ..... 236/49; 98/40 VT; 98/103; 236/100

[58] Field of Search ..... 236/49, 100; 98/40 VT, 98/103, 107, 108, 114

[56] References Cited

U.S. PATENT DOCUMENTS

| | | | |
|---|---|---|---|
| 1,884,794 | 10/1932 | McKee | 236/100 |
| 2,241,108 | 5/1941 | Akers | 236/49 |
| 2,523,497 | 9/1950 | Copping | 236/49 |
| 2,523,498 | 9/1950 | Copping | 236/49 |
| 2,523,499 | 9/1950 | Copping | 236/49 |
| 2,537,315 | 1/1951 | Newton | 236/49 |
| 2,628,032 | 2/1953 | Copping | 236/49 |
| 2,701,101 | 2/1955 | Peple, Jr. | 236/49 |
| 2,740,587 | 4/1956 | Kraft | 236/49 |
| 2,749,044 | 6/1956 | Chace | 236/49 |
| 2,814,977 | 12/1957 | Noll | 236/49 X |
| 3,165,999 | 1/1965 | Noll | 236/49 X |
| 3,645,108 | 2/1972 | Houk | 236/49 X |
| 3,743,180 | 7/1973 | Perkins et al. | 236/49 X |
| 4,055,954 | 11/1977 | Marks et al. | 60/527 |
| 4,151,952 | 5/1979 | Edwards | 236/49 |

*Primary Examiner*—William E. Tapolcai

*Attorney, Agent, or Firm*—Varnum, Riddering, Schmidt & Howlett

[57] ABSTRACT

An air register for distributing air to a room has a thermally responsive actuator element in direct contact with a pivotably mounted closure slat for controlling the flow of air through the register. The air is distributed upwardly along the wall of a room and a venturi, mounted in the air flow path, draws air in through an opening in the front of the register and over the actuator so that the actuator senses room temperature of the treated air passing through the register. The slats which control the flow of air through the register are biased in an open position and the actuator tends to close the slats through a direct linear force on the slats.

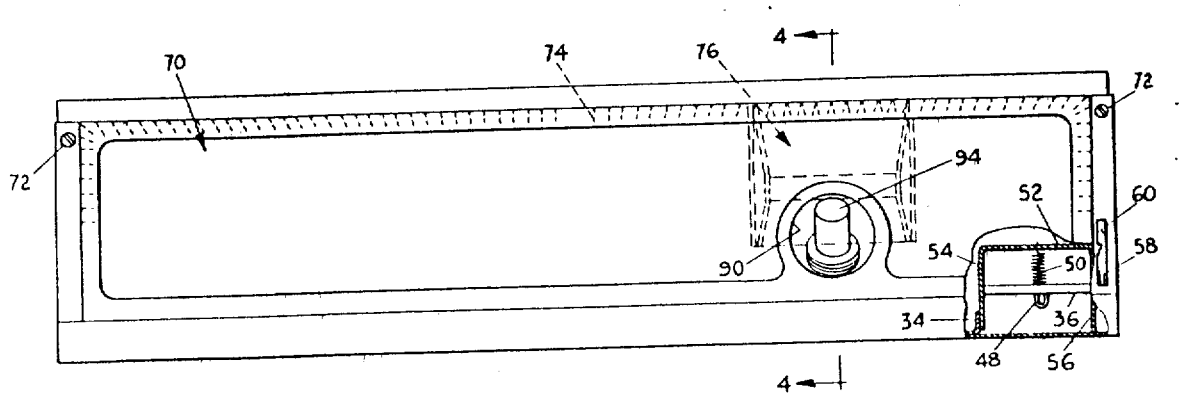

8 Claims, 4 Drawing Figures